US006974347B1

(12) United States Patent
Lin

(10) Patent No.: US 6,974,347 B1
(45) Date of Patent: Dec. 13, 2005

(54) PIERCEABLE COMMON CONTACT PLATE IN THE COMBINED SOCKETS OF CHRISTMAS LIGHT

(76) Inventor: Mei-Lu Lin, P.O. Box 697, Fongyuan City, Taichung County (TW) 420

( * ) Notice: Subject to any disclaimer, the term of this patent is extended or adjusted under 35 U.S.C. 154(b) by 0 days.

(21) Appl. No.: 10/917,431

(22) Filed: Aug. 13, 2004

(51) Int. Cl.[7] ..... H01R 4/24
(52) U.S. Cl. ..... 439/425; 439/419
(58) Field of Search ..... 439/419, 425, 439/699.1, 699.2, 417; 362/249, 226, 806, 362/241

(56) References Cited

U.S. PATENT DOCUMENTS

| | | | | |
|---|---|---|---|---|
| 4,777,573 | A * | 10/1988 | Liao | 362/249 |
| 5,366,386 | A * | 11/1994 | Liao | 439/419 |
| 5,672,000 | A * | 9/1997 | Lin | 362/249 |
| 6,257,736 | B1 * | 7/2001 | Fehrenbach | 362/226 |
| 6,328,593 | B1 * | 12/2001 | Chang et al. | 439/419 |
| 6,537,102 | B1 * | 3/2003 | Lin | 439/425 |

* cited by examiner

*Primary Examiner*—Hien Vu

(57) ABSTRACT

A pierceable common contact plate in the combined sockets of Christmas light includes a pair of sockets combined on their opened bottoms by an opened transverse portion, a pair of semi-cylindrical grooves in the center of the opened transverse portion, a plurality of retaining recesses symmetrically formed on two sides of the grooves and a pair of retaining slits respectively formed in the inner side of the front and back walls of the opened transverse portion for respectively disposing a pair of inverse U-shaped common contact plates each of which has a tip on outer edge of their transverse portions, a pair of electric wires disposed in the pair of grooves and pierced by the tips, a lid covered the opened transverse portion including a pair of corresponding semi-cylindrical grooves and a plurality of hooked retainers on inner side respectively engaged with the grooves and the retaining recesses of the combined sockets and a pair of lamps engaged within the upper rim of the sockets respectively each having a bulb and a pair of lead-in wires respectively engaged with the barbed vertical portions of the inverse U-shaped common contact plates.

2 Claims, 9 Drawing Sheets

PIERCEABLE COMMON CONTACT PLATE IN THE COMBINED SOCKETS OF CHRISTMAS LIGHT

BACKGROUND OF THE INVENTION

The present invention relates to the combined sockets and more particularly to the pierceable common contact plate in the combined sockets of the Christmas light which is readily to assemble and saves the consumption of the electric wires.

A type of combined double sockets or multiple sockets of Christmas lights provides more brightness and regular arrangement which enable the Christmas lights to appear the prominence both of the greater shining and beautification. Inspite of whether or not that the combined sockets are of double or multiple, they need not only a common contact plate disposed therebetween but also need a single positive or negative contact plate for themselves to build up an electric current therein. Either the common contact plate or the single contact plate requires to connect with an electric wire which was usually broken down to cause a poor conductibility of the electric power and consumed more electric wires. So that this type of the double or multiple combined sockets unexpectedly cost more than the single socket Christmas light.

Nowadays, a type of pierceable contact plate is used in a single socket for facilitating the connection of the electric current in the socket which proved was a good conductivity and saves the consumption of the electric wires than the conventional structure of socket. So far pierceable contact plate is still not used in the double or multiple combined sockets that misses the superiority of the combined sockets for Christmas lights.

SUMMARY OF THE PRESENT INVENTION

The present invention has a main object to provide a pierceable common contact plate in the combined sockets of Christmas light in which the common contact plate has tips on outer edge to automatically pierce into the electric wires for the connection of the electricity to lighten the lamps of the combined sockets for Christmas lights and the structure of the sockets facilitate a readily assembly of the components without wasting the material but appearing a neat and regular outer look.

Another object of the present invention is to provide a pierceable common contact plate in the combined sockets of Christmas light in which the contact plate is stable and has a perfect conductivity with the electric wires so as to ensure a smooth circulation of the electric current in the sockets.

Further object of the present invention is to provide a pierceable common contact plate in the combined sockets of Christmas light in which the concept of the common plate can be adaptable in the multiple combined sockets and is provided to keep a smooth circulation of electricity in the sockets.

Accordingly, the pierceable common contact plate in the combined sockets of Christmas light of the present invention comprises at least a pair of sockets combined on their opened bottoms by an opened transverse portion in which has a pair of semi-cylindrical groove in the center, a plurality of the retaining recesses on two sides of the cylindrical grooves and a pair of retaining slits in the inner side of the front and back walls for respectively engaging a pair of U-shaped common contact plates each of which has a tip on the transverse portion to pierce into a pair of electric wires which are parallel disposed in the semi-cylindrical grooves, a lid engaged with the opened transverse portion and having a pair of corresponding semi-cylindrical grooves covering the outer side of the electric wires and a plurality of hooked retainers respectively engaged within the retaining recesses and a pair of lamps respectively engaged into the upper rim of the sockets each of which has a pair of lead-in wires respectively contacting the vertical portions of the common contact plates.

The present invention will become more fully understood by reference to the following detailed description thereof when read in conjunction with the attached drawings.

DETAILED DESCRIPTION OF THE PREFERRED EMBODIMENTS

Figure 1:
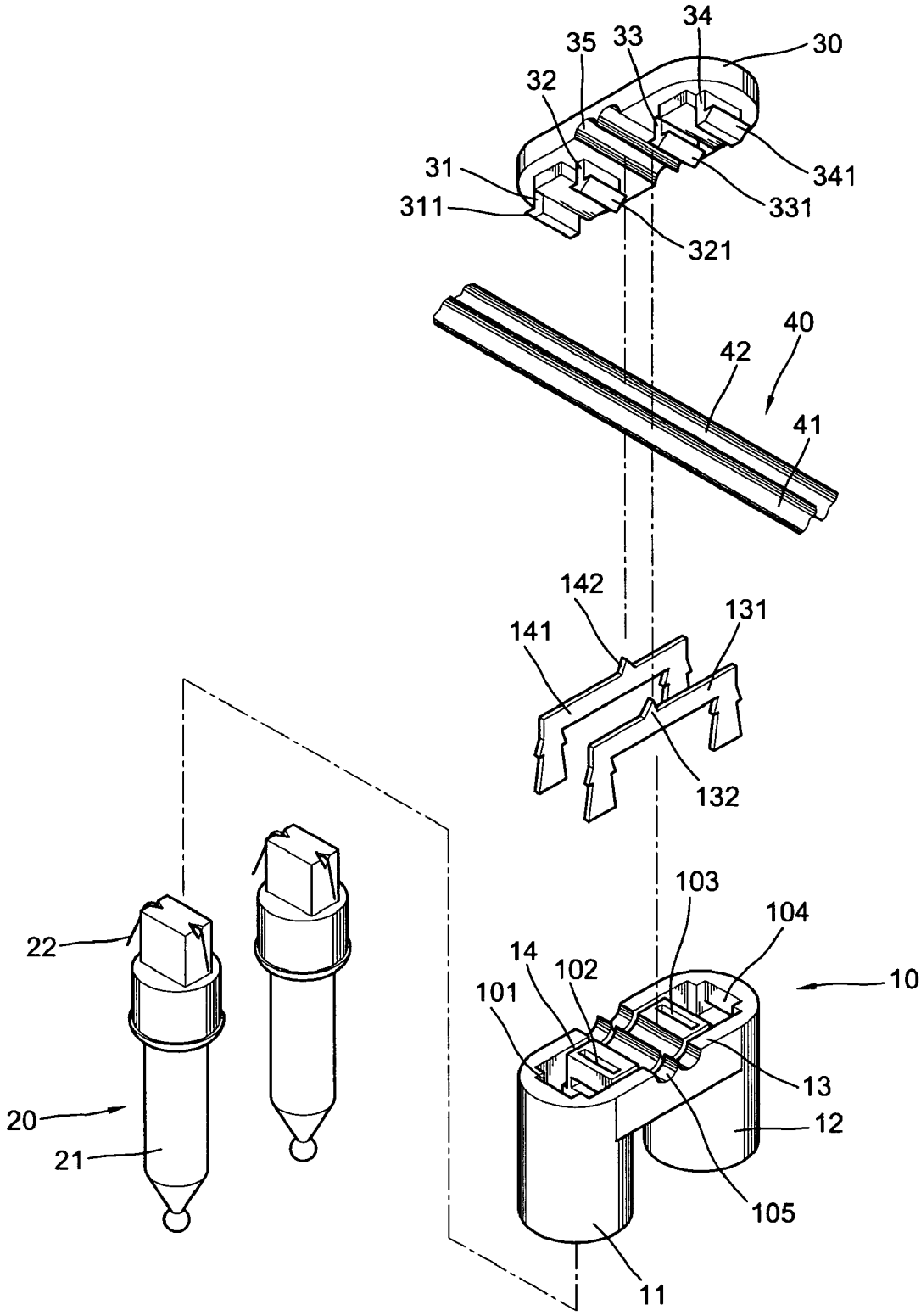
FIG. 1 is an exploded perspective view of the preferred embodiment of the present invention.

With reference to the drawings and initiated from FIGS. 1 to 5, a preferred embodiment of the pierceable common contact plate in the combined sockets of Christmas light of the present invention comprises a combined sockets 10 which is composed of s first and a second sockets 11 and 12 connected on their bottoms by an opened transverse portion 13, a pair of semi-cylindrical grooves 105 parallel formed in the center of the opened transverse portion 13, a first, second, third and fourth retaining recesses 101, 102, 103 and 104 symmetrically formed in two sides of the semi-cylindrical grooves 105 and a pair of retaining slits 14 respectively formed in the inner side of the front and back walls of the opened transverse portion 13 commutating within the hollow interior of the sockets 11 and 12.

A pair of inverse U-shaped common contact plates 131 and 141 disposed into the slits 14 of the combined sockets 10 each having a pair of vertical barked portions inserted into the sockets 11 and 12 respectively and a tip 132 and 142 alternately formed on the outer edge of the transverse portions of the inverse U-shaped common contact plates.

A pair of electric wires 40 which is combined with a pair of single electric wires 41 and 42 dispose in the pair semi-cylindrical grooves 105 of combined sockets 10 and respectively pierced by the tips 132 and 142 of the common contact plates 131 and 141.

A lid 30 engages with the opened transverse portion 13 of the combined sockets 10 and has a pair of corresponding semi-cylindrical grooves 35 in the center of the inner side covering the outer periphery of the single electric wires 41 and 42, a first, second, third and fourth retainers 31, 32, 33 and 34 each having a triangular hook 311, 321, 331, and 341 at free end symmetrically formed on two sides of the corresponding semi-cylindrical grooves 35 and respectively engaged within the retaining recesses 101, 102, 103 and 104 of the combined sockets 10 in a snap fitting.

Figure 2:
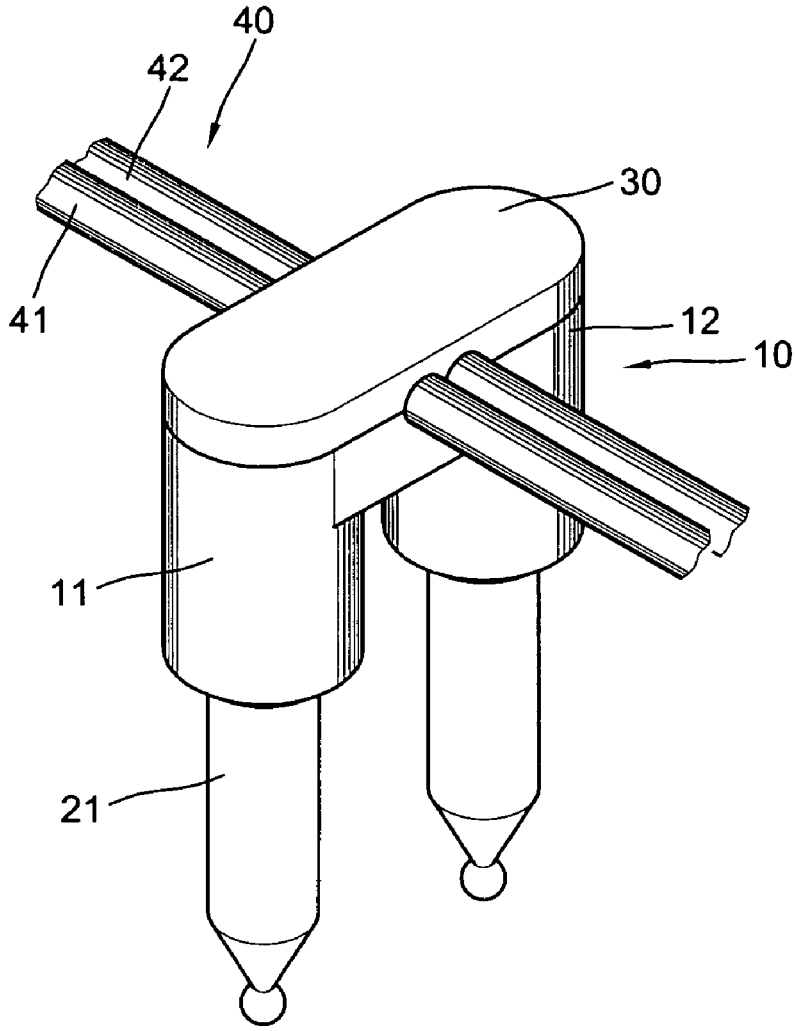
FIG. 2 is a perceptively to show the assembly of FIG. 1.
Figure 3:
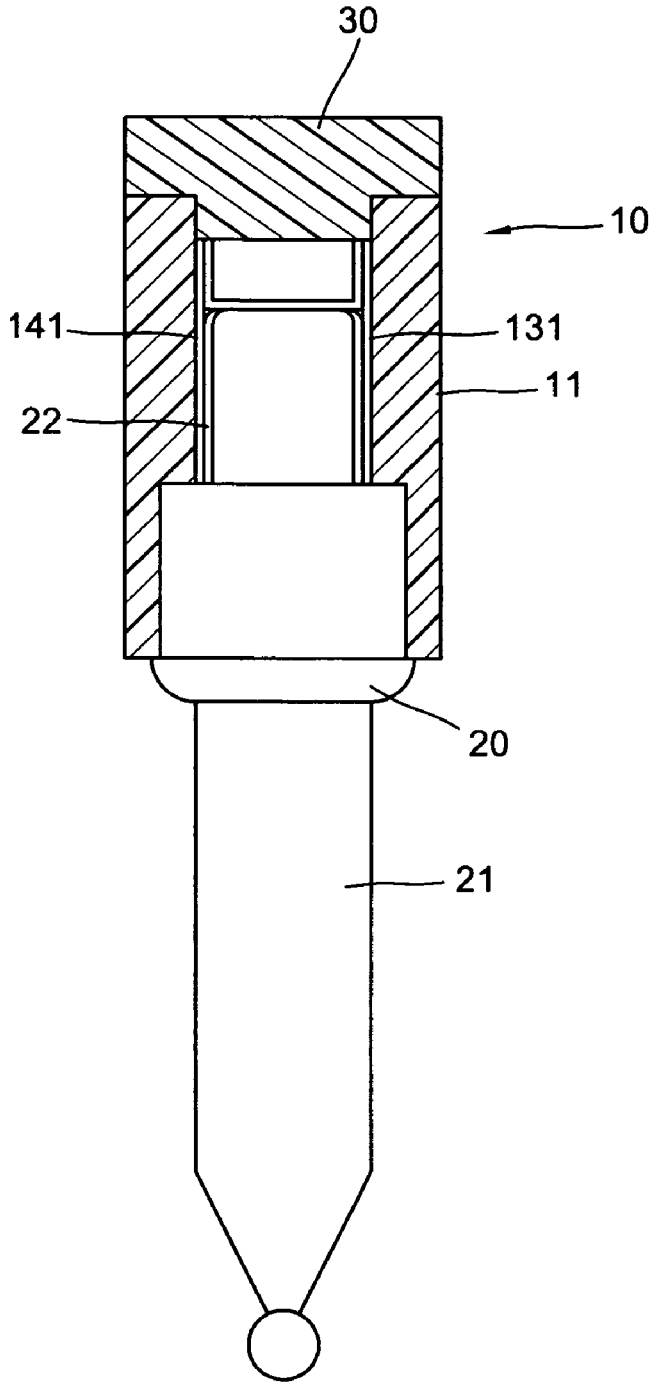
FIG. 3 is a sectional view to show inner structure of a first socket in the preferred embodiment.
Figure 4:
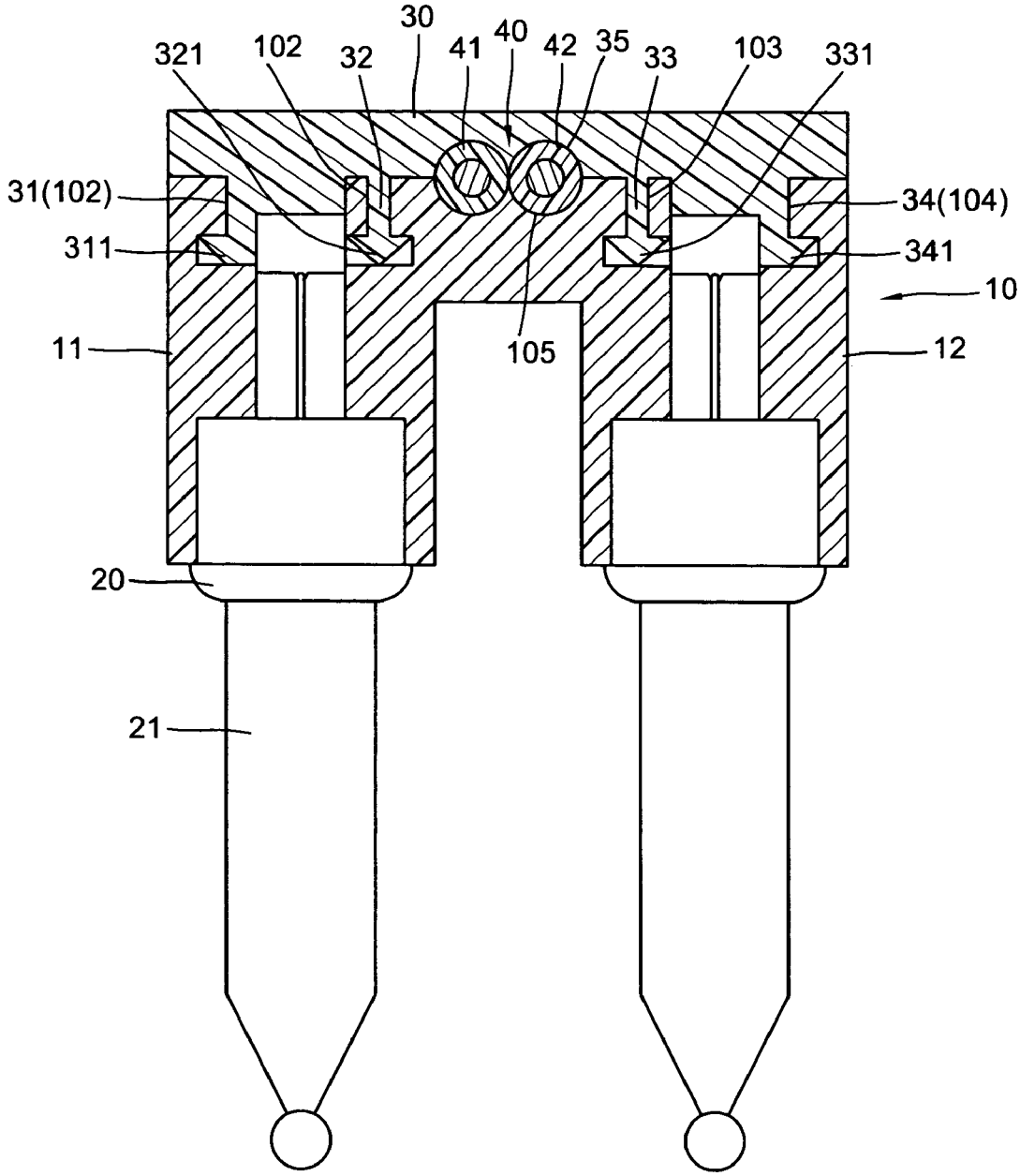
FIG. 4 is a sectional view to show the structure in the preferred embodiment.
Figure 5:
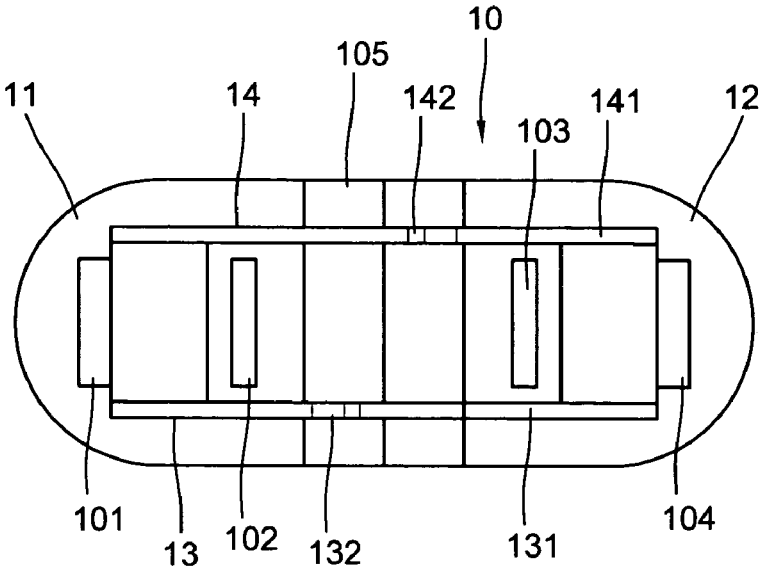
FIG. 5 is a plane view of preferred embodiment looking from the bottom thereof.
Figure 6:
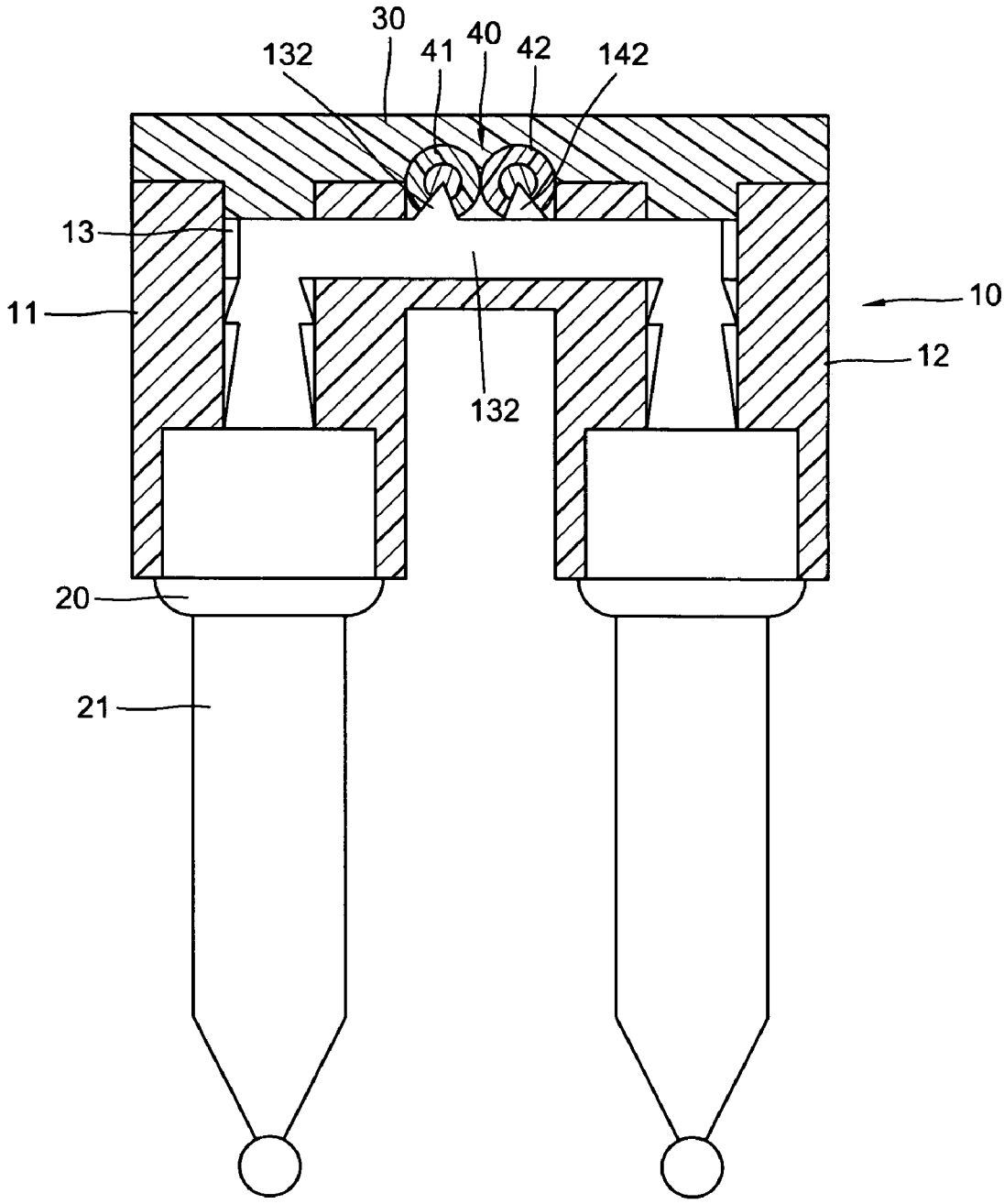
FIG. 6 is a sectional view to show that the tips of a pair of inverse U-shaped common contact plates are respectively pierced into the electric wires.

A pair of lamps 20 respectively engage within the upper rim of the sockets 11 and 12 and each has a bulb 21 and a pair of lead-in wires attached to the opposing lateral sides of the base and respectively engaged with the vertical portions of the inverse U-shaped common contact plates 131 and 141. FIGS. 2 and 6 show the assembled structure of the preferred embodiment of the combined sockets 10 of the present invention.

Therefore, the tips 132 and 142 of the inverse U-shaped common contact plates 131 and 141 are pierced into the single electric wires 41 and 42 that ensures the stable circulations of the electricity within the socket 11 and 12. This structure is first used in the combined sockets 10 that appears the novelty of the present invention.

Figure 7:
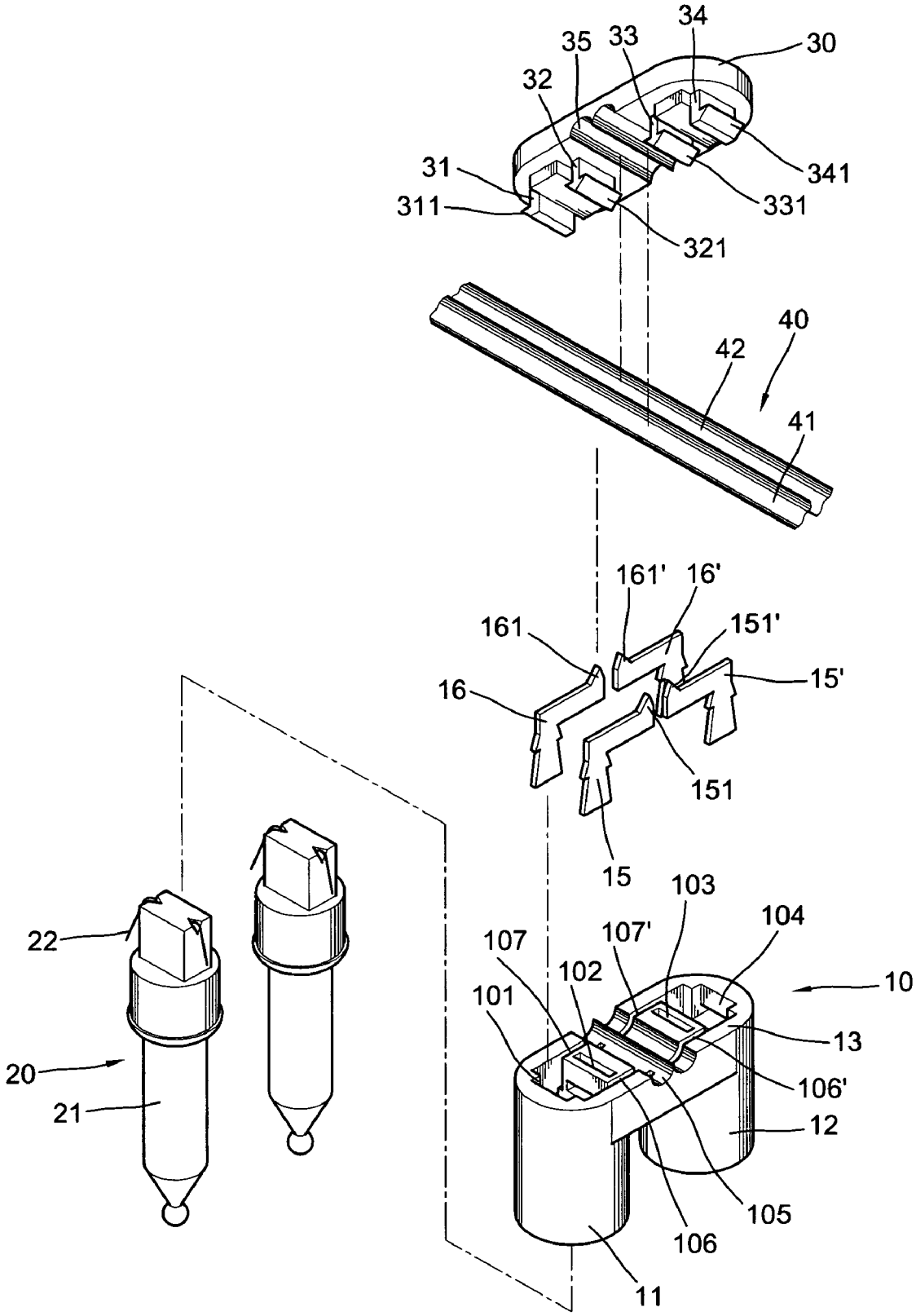
FIG. 7 is an exploded perspectively view of to show that the inverse U-shaped common contact plates are replaced with two pairs of L-shaped common contact plates.
Figure 8:
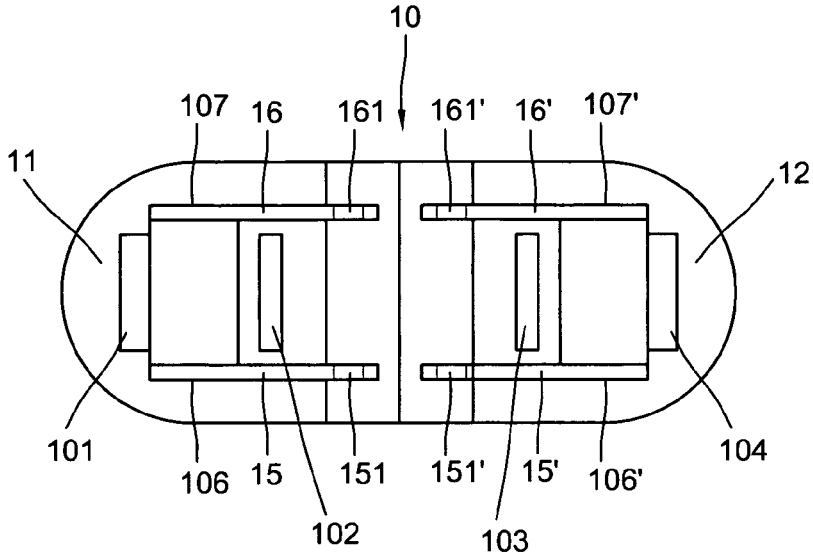
FIG. 8 is a plane view of the second embodiment looking from the bottom thereof to show the positions of the L-shaped common contact plates in the sockets.
Figure 9:
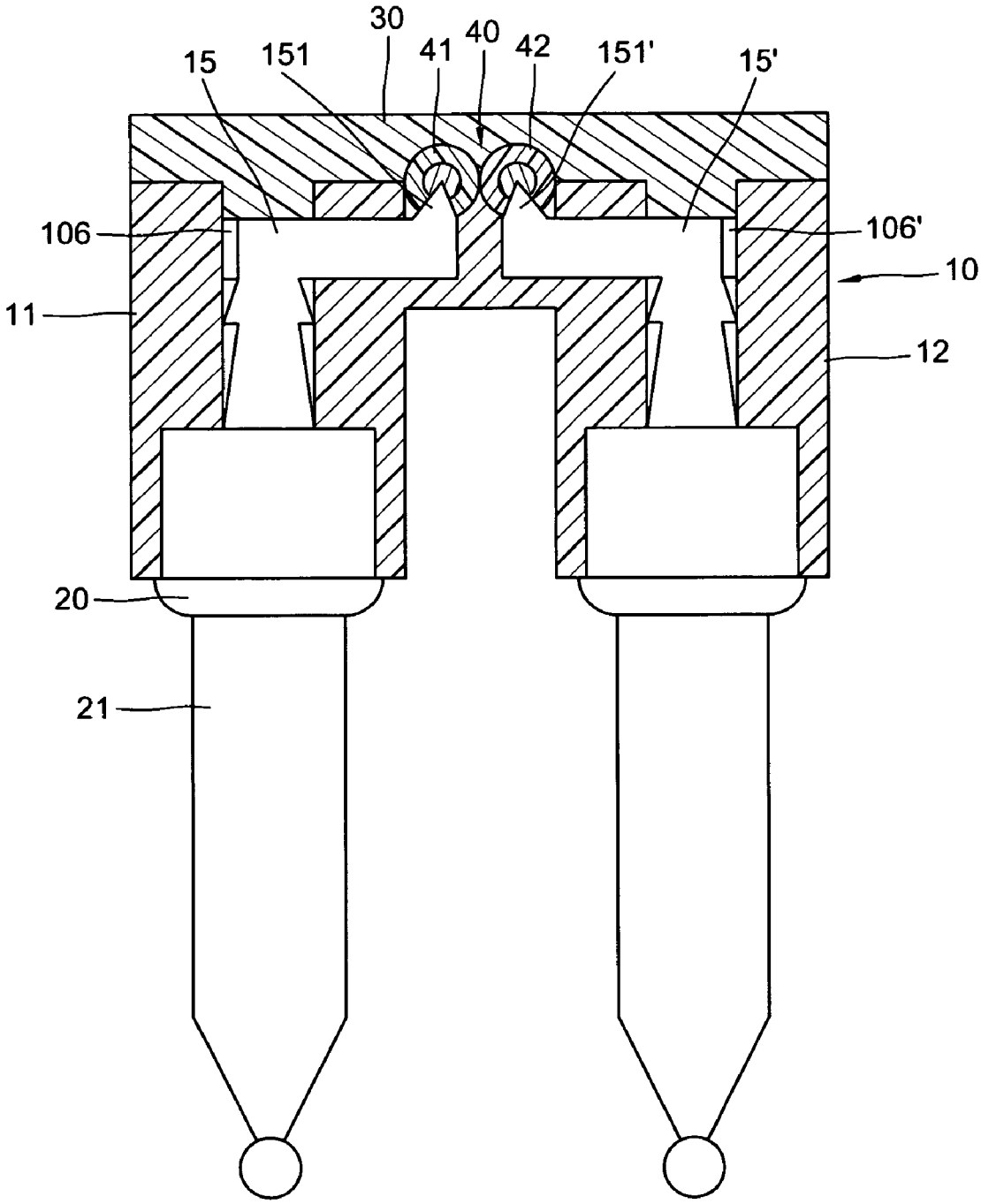
FIG. 9 is a sectional view to show that the tips of the L-shaped common contact plates pierce into the electric wires already.

Referring to FIGS. 7, 8 and 9 of the drawings, two pairs of the L-shaped common contact plates 15, 15', 16 and 16' may replace the pair of the inverse U-shaped common contact plates 131 and 141 (as shown in FIG. 1). Each of the L-shaped common contact plates 15, 15', 16 and 16' has a tip 151, 151', 161 and 161' on the free end of their transverse portions. In consistence with the change of the common contact plates 131 and 141, the pair of the retaining slits 14 are also replaced with two pairs of the separated retaining slits 106, 106', 107 and 107' in the opened transverse portion 13 of the combined sockets 10' 10.

Although the pierceable contact plate has previously used in the single socket. The structure of the single pierceable contact plate does not suitable to the combined sockets and the conception of the common contact plate only first uses in the embodiment of the present invention and proves to facilitate the mass production and readily to assemble and enables to keep the combined socket in the uniform directions.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A pierceable common contact plate in the combined sockets of Christmas light comprising:

a pair of first and second sockets combined together on their opened bottoms by an opened transverse portion, said sockets each having a hollow interior and an upper rim, a pair of semi-cylindrical grooves parallel formed in center of said opened transverse portion, a plurality retaining recesses symmetrically formed on two sides of said semi-cylindrical grooves and a pair of retaining slits in an inner side of front and back walls of said opened transverse portion for disposing a pair of inverse U-shaped common contact plates each of which has a pair of barbed vertical portions respectively inserted into the hollow interior of said sockets and a tip alternately formed on an outer edges of their transverse portions for respectively piercing into a pair of parallel arranged single wires which are disposed in said pair of semi-cylindrical grooves;

a lid engaged with said opened transverse portion of said combined sockets having a pair of corresponding semi-cylindrical grooves in center of an inner side covering on top of said single electric wires and a plurality of retainers each having a triangular hook at free end symmetrically formed on inner side beside said corresponding semi-cylindrical grooves and respectively engaged within the retaining recesses of said combined sockets in a snap fitting;

a pair of lamps respectively engaged into the upper rims of said sockets each having base, a bulb and a pair of lead-in wires attached to lateral peripheries of said base and engaged with the vertical portions of said inverse U-shaped common contact plates respectively.

2. The pierceable common contact plate as recited in claim 1, wherein said opened transverse portion may have two pairs of separated retaining slits in inner side of said front and back walls for respectively disposing two pairs of L-shaped common contact plates which replace the pair of the inverse U-shaped common contact plates.

* * * * *